United States Patent [19]

Ryder et al.

[11] Patent Number: 4,804,008

[45] Date of Patent: Feb. 14, 1989

[54] WINDPROOF UMBRELLA

[76] Inventors: Peter M. Ryder, c/o George Spector, 233 Broadway, Rm 3815; George Spector, 233 Broadway, Rm 3815, both of, New York, N.Y. 10007

[21] Appl. No.: 113,591

[22] Filed: Oct. 28, 1987

[51] Int. Cl.[4] ..... A45B 25/22

[52] U.S. Cl. ..... 135/35 V

[58] Field of Search ..... 135/35 V, 93, 35 R

[56] References Cited

U.S. PATENT DOCUMENTS

| | | | |
|---|---|---|---|
| 1,031,974 | 7/1912 | Thomas | 135/35 V |
| 3,024,717 | 3/1962 | Rozek | 135/93 X |
| 3,032,047 | 5/1962 | Wendorf | 135/35 V |
| 3,436,661 | 7/1969 | Farley | 135/35 V |
| 3,802,451 | 4/1974 | Morris | 135/35 |
| 3,960,162 | 6/1976 | Noel | 135/35 V |

*Primary Examiner*—J. Karl Bell

[57] ABSTRACT

A windproof umbrella is provided and contains vents to release air pressure build up from below the umbrella cover so that the umbrella will not turn inside out. In a modification vents can be adapted to be attached to a standard umbrella so that air pressure build up can be eliminated.

5 Claims, 1 Drawing Sheet

WINDPROOF UMBRELLA

BACKGROUND OF THE INVENTION

The instant invention relates generally to umbrellas and more specifically it relates to a windproof umbrella which is vented to minimize the risk of its destruction during high winds.

Numerous umbrellas have been provided in prior art that are adapted to release air pressure through vents in a high wind. For example, U.S. Pat. Nos. 1,031,974; 3,032,047; 3,456,661 and 3,960,162 all are illustrative of such prior art. While these units may be suitable for the particular purpose to which they address, they would not be as suitable for the purposes of the present invention as heretofore described.

SUMMARY OF THE INVENTION

A principle object of the present invention is to provide a windproof umbrella having vents to release air pressure build up from below so that the umbrella will not turn inside out.

Another object is to provide a windproof umbrella having vents that open in such a way as to prevent rain water from entering the umbrella.

An additional object is to provide a windproof umbrella in which the vents can be adapted to a standard umbrella so that air pressure build up can be eliminated.

A further object is to provide a windproof umbrella that is simple and easy to use.

A still further object is to provide a windproof umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
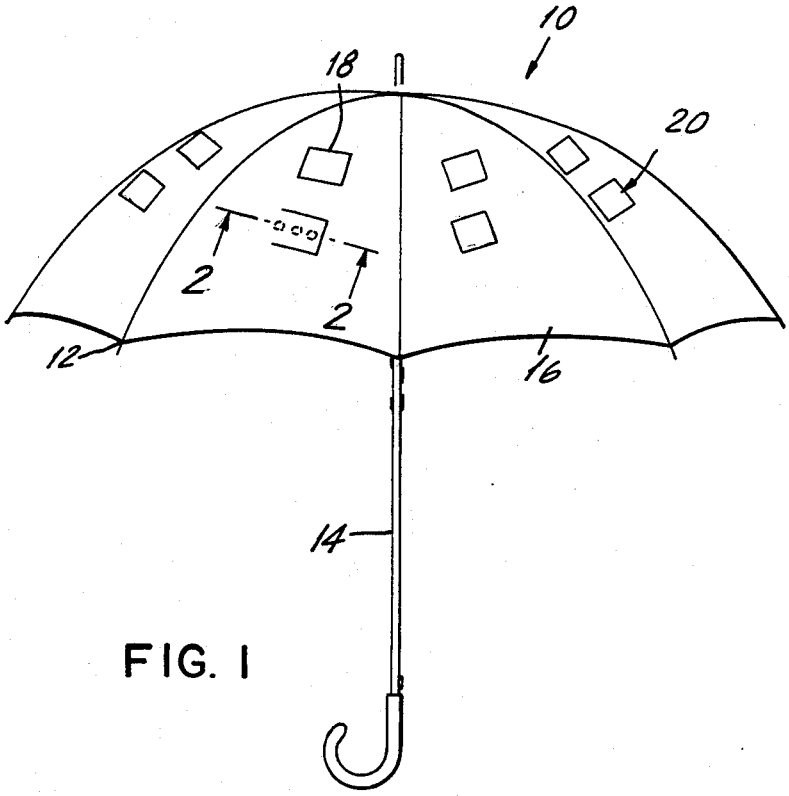
FIG. 1 is an elevational view of an umbrella in an open position embodying the invention.

Turning now descriptively to the drawings, in which similar reference characters denote similar elements throughout the several views, FIG. 1 illustrates a windproof umbrella 10 of the type having a collapsible frame 12 attached to a rod 14. The invention consists of a fabric cover 16 that has a plurality of apertures 18 therein attached to the collapsible frame 12 and a plurality of normally closed vents 20. Each vent 20 is connected to and located within one of the apertures 18 in the fabric cover 16. When air pressure builds up from below the cover the vents 20 will open to release the air pressure and prevent rain water from entering.

Figure 2:
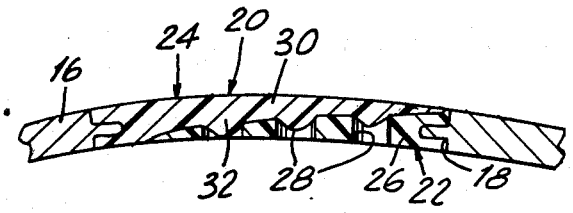
FIG. 2 is an enlarged cross sectional view taken along line 2—2 in FIG. 1 showing a vent with a flexible flap closed.
Figure 3:
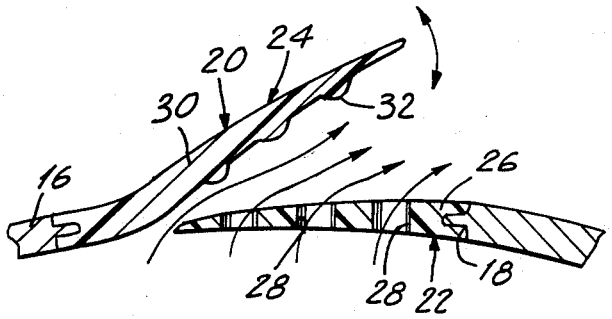
FIG. 3 is an enlarged cross sectional view similar to FIG. 2 showing the vent with the flexible flap fully open.

FIGS. 2 and 3 show one of the vents 20 in greater detail in closed and opened positions. The vent 20 contains a lower portion 22 and an upper portion 24. The lower portion 22 is a tapered and stationary base 26 that has a plurality of openings 28 therein. The upper portion 24 is a tapered and flexible flap 30 that has a plurality of lower detents 32 for contacting the openings 28 in the stationary base 26. The amount of air pressure will control the opening and closing of the flexible flap 30.

The lower portion 22 and the upper portion 24 of each of the vents 20 are fabricated out of durable plastic material.

Figure 4:
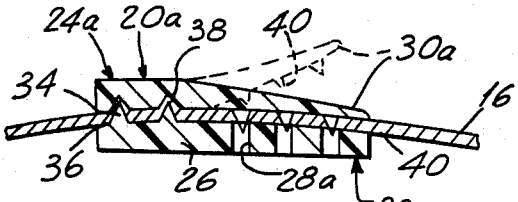
FIG. 4 is an enlarged cross sectional view similar to FIG. 2 of a modification for adapting a standard umbrella with an air pressure releasing vent.

FIG. 4 shows a modified normally closed vent **20*a* which is sandwiched to and perforates the fabric cover 16. The lower portion 22*a* is a stationary base 26*a* that has a plurality of upper male gripping detents 34 and a plurality of openings 28*a*. The base 26*a* is positioned under the cover 16 so that the male gripping detents 34 engage the cover 16. Adhesive 36 can be placed on top of the stationary base 26*a* to help in holding it to the cover 16**.

The upper portion **24*a* is a tapered and flexible flap 30*a* that has a plurality of lower female gripping indents 38 and a plurality of lower male piercing detents 40. The flap 30*a* is positioned over the cover 16 so that the female gripping indents 38 will engage the cover 16 in alignment with the male gripping detents 34**.

The male piercing detents 40 will perforate the cover 16 for contacting the openings **28*a* in the stationary base 26*a*. The amount of air pressure will control the opening and closing of the flexible flap 30*a***.

The lower portion **22*a* and the upper portion 24*a* of each of the vents 20*a*** are also fabricated out of durable plastic material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A windproof umbrella of the type having a fabric cover affixed to a collapsible frame attached to a rod comprising a plurality of normally closed vents, each of which is sandwiched to and perforates said fabric cover whereby when air pressure builds up from below said cover said vents will open to release said air pressure and prevent rain water from entering.

2. A windproof umbrella as recited in claim 1, wherein each of said vents comprises:

(a) a lower portion being a stationary base having a plurality of upper male gripping detents and a plurality of openings, said base positioned under said cover so that said male gripping detents engage said cover; and (b) an upper portion being a tapered and flexible flap having a plurality of lower female gripping indents and a plurality of lower male piercing detents, said flap positioned over said cover so that said female gripping indents will engage said cover in alignment with said male gripping detents and said male piercing detents will perforate said cover for contacting said opening in said stationary base in which the amount of said air pressure will control the opening and closing of said flexible flap.

3. A windproof umbrella as recited in claim 2, wherein said lower portion and said upper portion of each of said vents are fabricated out of durable plastic material.

4. A windproof umbrella of the type having a collapsible frame attached to a rod comprising:

(a) a fabric cover having a plurality of apertures therein said cover attached to said collapsible frame; and (b) a plurality of normally closed vents, each of which is connected to and located within one of said apertures in said fabric cover whereby when air pressure builds up from below said cover said vents will open to release said air pressure and prevent rain water from entering, wherein each of said vents comprises:

(c) a lower portion being a tapered and stationary base having a plurality of openings therein; and (d) an upper portion being a tapered and flexible flap having a plurality of lower detents for contacting said openings in said stationary base so that the amount of said air pressure will control the opening and closing of said flexible flap.

5. A windproof umbrella as recited in claim 4, wherein said lower portion and said upper portion of each of said vents are fabricated out of durable plastic material.

* * * * *